US006971256B2

(12) United States Patent
Okada et al.

(10) Patent No.: US 6,971,256 B2
(45) Date of Patent: Dec. 6, 2005

(54) METHOD AND APPARATUS FOR INCREMENTAL FORMING

(75) Inventors: Norihisa Okada, Hikari (JP); Gen Ro, Fujinomiya (JP); Yohji Suzuki, Shizuoka (JP)

(73) Assignees: Hitachi, Ltd., Tokyo (JP); Amino Corporation, Fujinomiya (JP)

( * ) Notice: Subject to any disclaimer, the term of this patent is extended or adjusted under 35 U.S.C. 154(b) by 89 days.

(21) Appl. No.: 10/642,698

(22) Filed: Aug. 19, 2003

(65) Prior Publication Data

US 2004/0187545 A1 Sep. 30, 2004

(30) Foreign Application Priority Data

Mar. 28, 2003 (JP) ..... 2003-089944

(51) Int. Cl.[7] ..... B21B 27/06

(52) U.S. Cl. ..... 72/69; 72/115; 72/342.1; 72/342.24

(58) Field of Search ..... 72/69, 115, 342.1, 72/342.7, 342.8, 342.94, 379.2

(56) References Cited

U.S. PATENT DOCUMENTS 4,145,908 A * 3/1979 Miller ..... 72/342.92
5,218,849 A * 6/1993 Sieger et al. ..... 72/69
6,006,569 A 12/1999 Shrayer et al.
6,532,786 B1 * 3/2003 Luttgeharm ..... 72/115
6,561,002 B2 * 5/2003 Okada et al. ..... 72/115
6,640,604 B2 * 11/2003 Matsushita ..... 72/342.1

FOREIGN PATENT DOCUMENTS

| | | |
|---|---|---|
| DE | 40 34 625 A1 | 5/1992 |
| DE | 44 25 033 A1 | 1/1996 |
| EP | 0 970 764 A1 | 1/2000 |
| JP | 2000-153313 | 6/2000 |
| JP | 2002-102945 | 4/2002 |

OTHER PUBLICATIONS

European Search Report for EP 03 25 5185, completed Nov. 17, 2003.

* cited by examiner

*Primary Examiner*—Ed Tolan
(74) *Attorney, Agent, or Firm*—Antonelli, Terry, Stout and Kraus, LLP.

(57) ABSTRACT

An incremental forming apparatus 100 holds a workpiece 10 onto a table 110. A spindle is disposed perpendicularly above table 110. For incremental forming, an incremental forming tool 150 is mounted on the spindle, and a form portion 20 is formed on the workpiece 10. When incremental forming is completed, the tool on the spindle is replaced with a straightening tool 200, and hot air is blown out from the straightening tool 200 to anneal the edge lines 20*a* and 20*b* of the form portion 20 and to eliminate process strain.

2 Claims, 3 Drawing Sheets

METHOD AND APPARATUS FOR INCREMENTAL FORMING

FIELD OF THE INVENTION

The present invention relates to an incremental forming method and incremental forming apparatus for forming a metal member without using a press mold.

DESCRIPTION OF THE RELATED ART

Patent document 1, Japanese Patent Laid-Open Publication No. 2002-1444 (European Patent Application Publication No. 1147832 A2), discloses an incremental forming method according to which a rod shaped tool is applied to the surface of a metal plate material and incremental forming is carried out by shaping the plate member with the tool along a contour line corresponding to the shape of the product to be formed.

FIG. 4 shows the shape of the product to be formed by incremental forming.

Incremental forming is a technique for forming a product 1 from a metal plate workpiece 10 by supporting the workpiece at a plane formed of an X axis and a Y axis, moving the forming tool 150 along a contour line in the Z-axis direction of a form portion 20, thereby drawing the metal plate to form the product 1.

During processing, a portion that does not block the movement of the forming tool 150 in the metal plate 10 or the periphery of the plate 10 is supported by a fixing jig.

As shown in FIG. 5, when the product 1*a* is removed from the mounting jig after the forming process, a flat end 10*a* is deformed from a predetermined shape 10 by the stress provided during processing.

SUMMARY OF THE INVENTION

The present invention provides a method and apparatus for incremental forming that solves the above-mentioned problems of the prior art.

In order to achieve the above object, the present invention provides a method for incremental forming carried out by applying an incremental forming tool to a metal workpiece and performing forming along a contour line, comprising: a step of carrying out incremental forming by applying the incremental forming tool to the metal workpiece and moving the incremental forming tool along the contour line; and a step of supplying heat to a strained portion of a product formed through the incremental forming step.

Moreover, the apparatus for incremental forming according to the present invention comprises a table having a workpiece holder and a workpiece clamp for holding the periphery of a metal workpiece, a spindle disposed perpendicular to the plane formed by the table, and a means for relatively moving the table and the spindle.

Further, a straightening tool comprises a shank portion to be inserted to the spindle, a hot-air blowout portion, an electric heater for heating the air being supplied, a sensor for detecting the temperature of the hot air at the blowout portion, and a controller for controlling the heater based on the data from the sensor. Furthermore, the apparatus comprises a means for controlling the hot-air blowout portion of the straightening tool so that a predetermined distance is maintained between the blowout portion and the surface of the treated portion.

DETAILED DESCRIPTION OF THE PREFERRED EMBODIMENT

Figure 1:
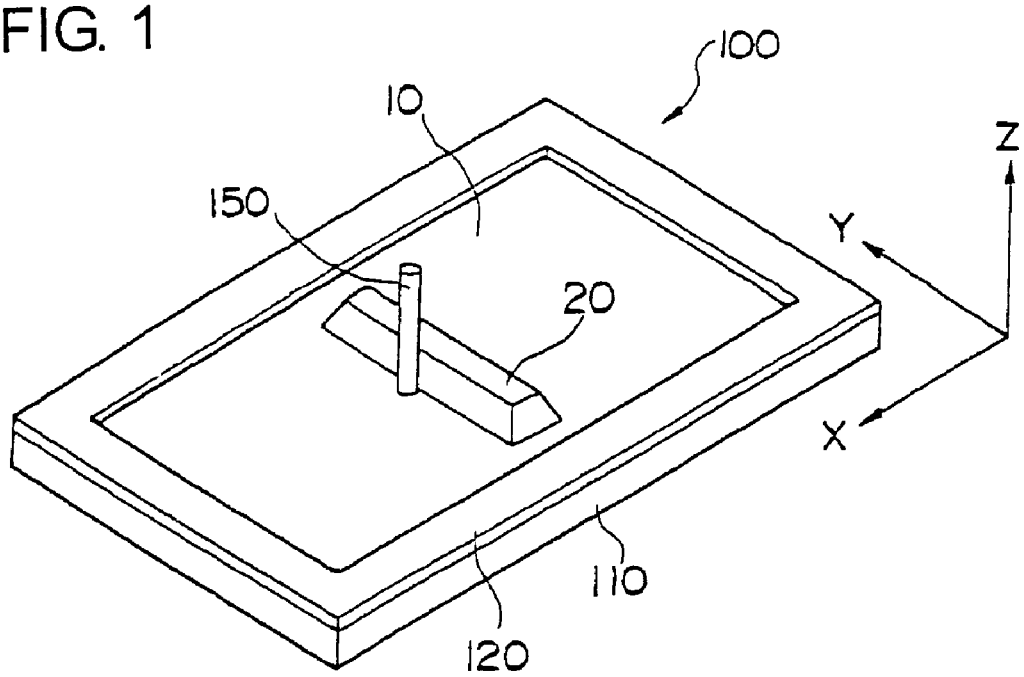
FIG. 1 is an explanatory view showing the incremental forming process according to the incremental forming apparatus of the present invention.
Figure 2:
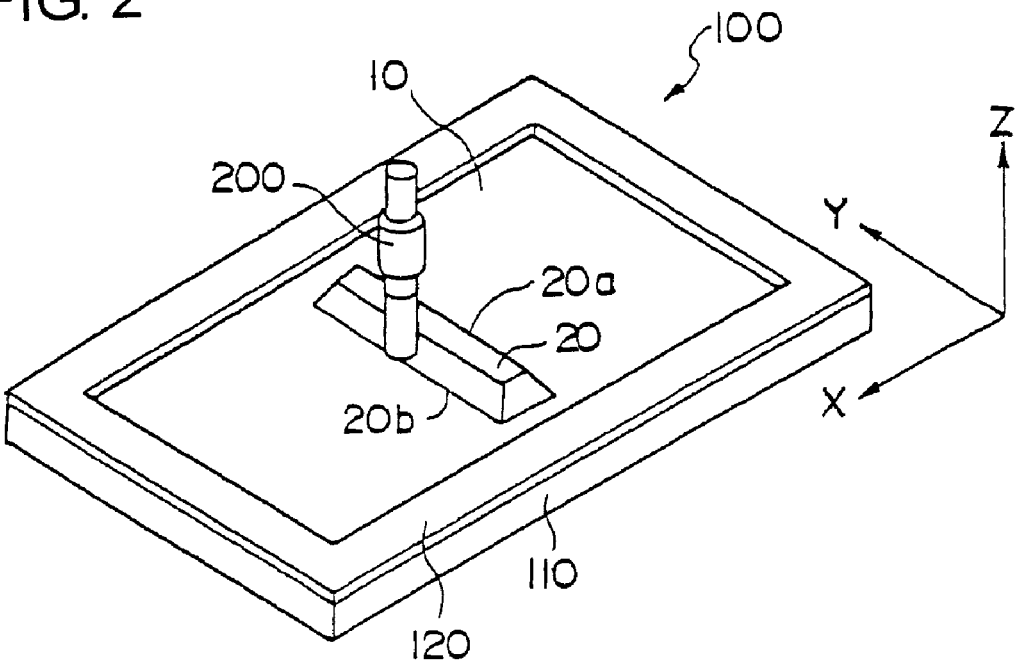
FIG. 2 is an explanatory view showing the straightening process according to the incremental forming apparatus of the present invention.

FIG. 1 shows the incremental forming step according to the incremental forming apparatus of the present invention, and FIG. 2 is an explanatory view showing the straightening step.

As shown in FIG. 1, the incremental forming apparatus, denoted as a whole by reference number 100, comprises a table 110 for mounting a metal plate workpiece 10 which is the material subjected to incremental forming disposed along an X-Y plane, and a workpiece clamp 120 that holds the periphery of the workpiece onto the table. The periphery of the workpiece 10 is supported between the table 110 and the workpiece clamp 120, and thus the workpiece is fixed to position. At the center of the table 110 is disposed a mold that corresponds to a form portion 20. The table 110 and the workpiece clamp 120 are capable of moving in the perpendicular direction or up-down direction with respect to the mold.

An incremental forming tool 150 is disposed on a spindle and the like not shown, which can be moved relatively along the X-Y plane with respect to the workpiece 10, and can also be controlled in a Z-axis direction (perpendicular direction).

In carrying out incremental forming, an incremental forming tool 150 is applied to a workpiece 10 supported between the table 110 and the workpiece clamp 120, and the tool is relatively moved along the X-Y plane in the shape of the form portion 20, the tool 150 moving along the contour line of the form portion 20 first in the Y-axis direction, then in the X-axis direction, again in the Y-axis direction, and then in the X-axis direction. When the incremental forming tool 150 is moved around the mold once, the tool 150 is moved downward (in the direction of the Z axis), along with which movement the table 110 and the workpiece clamp 120 are also moved downward, before the incremental forming tool 150 is moved along the contour line of the form portion 20. This operation is repeated for a number of times.

The conditions for incremental forming vary according to the material of the workpiece 10.

For example, if the workpiece 10 is a plate member made of aluminum alloy, the speed of relative movement between the tool and the workpiece is approximately 30000 mm/min at maximum, and the pitch of the contour line is approximately 0.5 mm.

During the process, the tip of the tool 150 is constantly in contact with the workpiece.

FIG. 2 is an explanatory view showing the straightening process according to the present apparatus.

First, the incremental forming tool 150 is mounted on a spindle in the incremental forming apparatus 100, and incremental forming is carried out to create the form portion 20. After creating the form portion 20, the incremental forming tool 150 is removed from the spindle, and a straightening tool 200 is mounted thereto. This tool replacement can be carried out automatically using an automatic tool exchange device.

Figure 3:
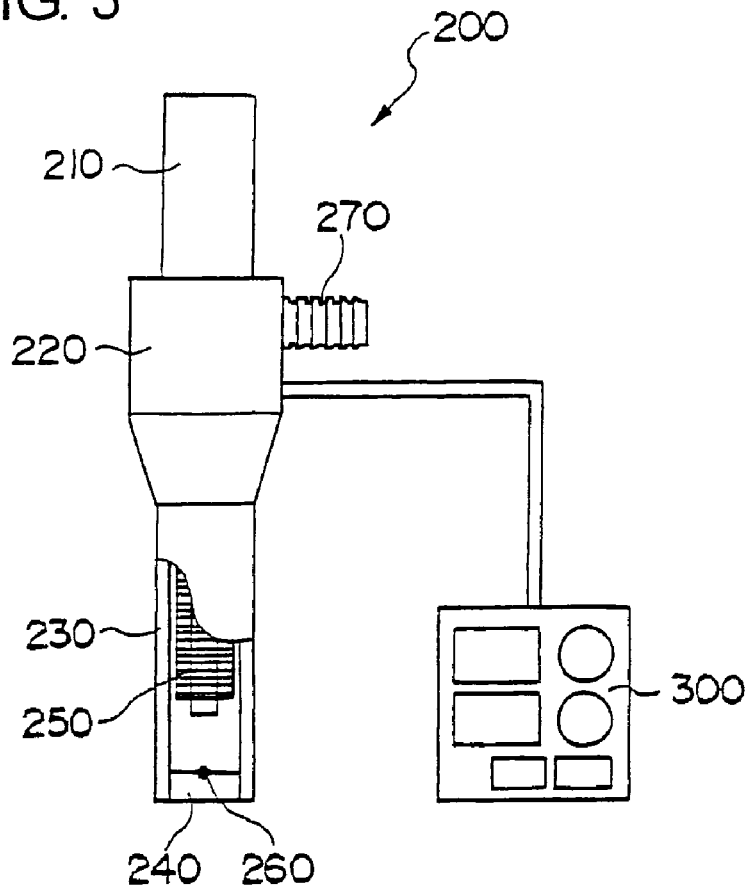
FIG. 3 is an explanatory view showing the straightening tool according to the incremental forming apparatus of the present invention.
Figure 4:
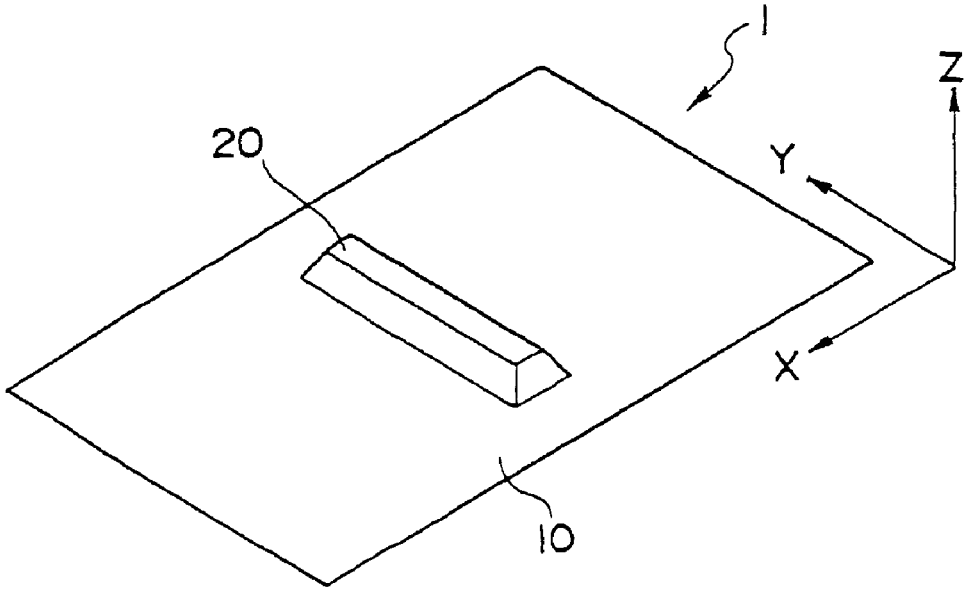
FIG. 4 is an explanatory view of the incremental forming according to the prior art.
Figure 5:
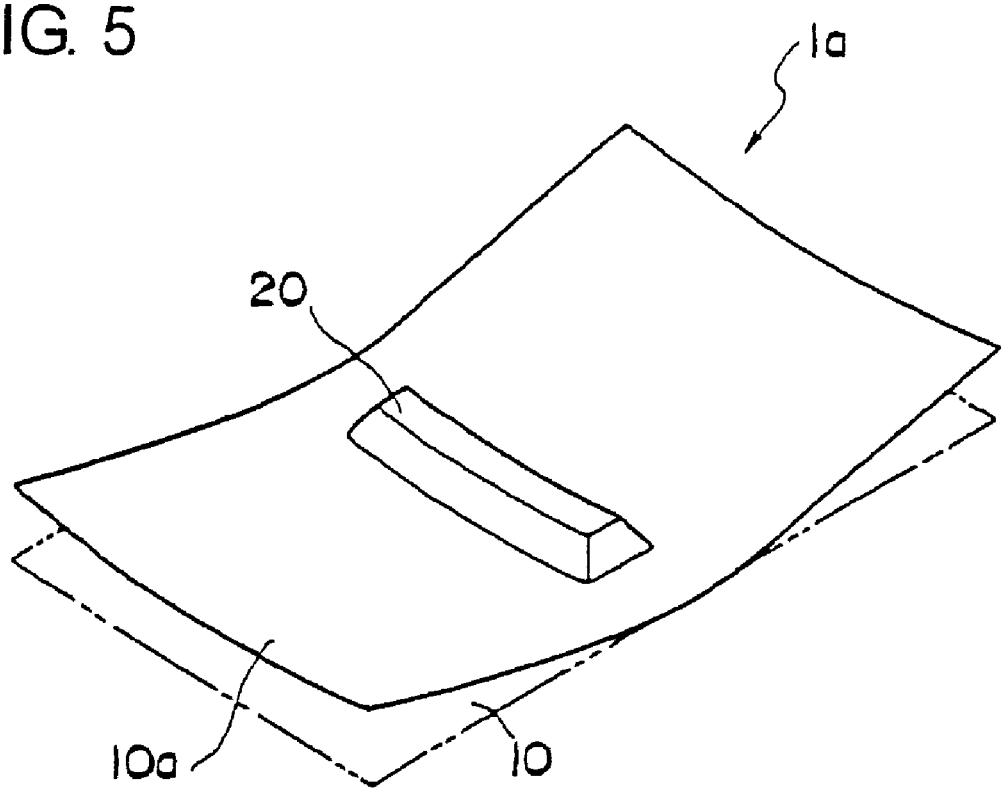
FIG. 5 is an explanatory view of the strain created by incremental forming according to the prior art.

FIG. 3 is an explanatory view showing the details of the straightening tool 200.

The straightening tool 200 comprises a shank portion 210 to be inserted to the spindle not shown of the incremental forming apparatus 100. The straightening tool 220 comprises a hot-air blowout pipe 230, and a heater 250 disposed within the body 220 and hot-air blowout pipe 230.

As for the heater 250, an electric heater that converts electricity to heat can be used, for example.

The body 220 is provided with an air supply pipe 270, through which the device is supplied of air from an air supply source not shown.

The air supplied to the body is heated through the heater 250, and discharged through a nozzle 240 at the tip of the hot-air blowout pipe as heated air.

A thermocouple 260 is provided to the interior of the nozzle portion 240, for detecting the temperature of the hot air being discharged.

The detected data is sent to a controller 300. The controller 300 controls the heater 250 so that the hot air being discharged through the nozzle 240 maintains a predetermined temperature.

If the workpiece is made of aluminum alloy, the conditions for the straightening process carried out by blowing hot air to the workpiece are as follows.

The temperature of the hot air being discharged through the nozzle is controlled to approximately 800° C., while the speed of movement is set to approximately 1000 mm/min.

The distance between the nozzle and the workpiece is set to approximately 20 mm. The control of relative movement between the nozzle and workpiece can be automated easily by correcting the NC program used for the incremental forming.

The path of movement of the nozzle during the straightening step depends on the shape of the workpiece, but if the workpiece has a form portion 20 like the one shown in the drawings, the work is annealed by heating the area near an upper edge line 20*a* and a lower edge line 20*b* of the form portion, thereby removing the strain created by the incremental forming.

In the above embodiment, the workpiece is supported by having its periphery clamped and moved in the vertical direction, but strain is caused even if the work is supported by having its center area clamped, so the same straightening annealing process should be carried out.

Moreover, heating devices using laser, plasma or halogen lamp can also be utilized as the heat supply apparatus.

What is claimed is:

1. An incremental forming apparatus comprising: a table for mounting a metal workpiece; a workpiece clamp for fixing the metal workpiece to the table; a spindle disposed perpendicular to a plane formed by the table; and a means for relatively moving the table and the spindle; wherein the spindle mounts an incremental forming tool and a straightening tool in an exchangeable manner; and wherein the straightening tool comprises a shank portion to be inserted to the spindle, a hot-air blowout portion, an electric heater for heating an air to be supplied, a sensor for detecting temperature of the hot air at the blowout portion, and a controller for controlling the heater based on data from the sensor.

2. The incremental forming apparatus according to claim 1, further comprising a means for moving the hot-air blowout portion of the straightening tool maintaining a predetermined distance from a surface of a processing portion.

* * * * *